US007845514B2

(12) United States Patent
Rush et al.

(10) Patent No.: US 7,845,514 B2
(45) Date of Patent: Dec. 7, 2010

(54) FILLED POLYSTYRENE TEAR BACK CONTAINER LIDS

(75) Inventors: Jonathan E. Rush, Mount Bethel, PA (US); Trung Tran, Markham (CA); Virginia Lam, legal representative, Markham (CA)

(73) Assignee: Dixie Consumer Products LLC, Atlanta, GA (US)

( * ) Notice: Subject to any disclaimer, the term of this patent is extended or adjusted under 35 U.S.C. 154(b) by 163 days.

(21) Appl. No.: 11/682,637

(22) Filed: Mar. 6, 2007

(65) Prior Publication Data

US 2008/0217346 A1 Sep. 11, 2008

(51) Int. Cl.
*B65D 51/20* (2006.01)
*A47G 19/22* (2006.01)

(52) U.S. Cl. ..... 220/712; 220/254.3; 220/270; 220/265; 220/832; 229/404

(58) Field of Classification Search ..... 220/254.1, 220/254.3, 254.4, 711–718, 831, 832, 268, 220/270, 271, 709; 229/906, 404; D9/438, D9/447, 449, 450; 215/254, 255
See application file for complete search history.

(56) References Cited

U.S. PATENT DOCUMENTS 2,003,657 A * 6/1935 Stubblefield ..... 215/309
3,311,288 A 3/1967 Lemelson
3,362,563 A 1/1968 Koll
3,381,848 A * 5/1968 Brown ..... 220/273
3,421,654 A 1/1969 Hexel
3,426,959 A 2/1969 Lemelson
3,442,416 A * 5/1969 Nicholson ..... 220/269
3,615,034 A 10/1971 Lemelson
3,701,454 A * 10/1972 Thorp ..... 220/270
D239,600 S * 4/1976 Newman ..... D9/447
D239,601 S * 4/1976 Newman ..... D9/447
D239,603 S * 4/1976 Newman ..... D9/447
D239,604 S * 4/1976 Newman ..... D9/447
D239,605 S * 4/1976 Newman ..... D9/447
D239,606 S * 4/1976 Newman ..... D9/447
D239,607 S * 4/1976 Newman ..... D9/447
D240,020 S * 5/1976 Newman ..... D9/447
D240,402 S * 7/1976 Newman ..... D9/447
D240,403 S * 7/1976 Newman ..... D9/447
D240,601 S * 7/1976 Newman ..... D9/447
D240,602 S * 7/1976 Newman ..... D9/447
3,977,559 A 8/1976 Lombardi
3,994,411 A 11/1976 Elfelt et al.
4,103,804 A 8/1978 Fournier et al.

(Continued)

FOREIGN PATENT DOCUMENTS

CA 1211610 9/1986

(Continued)

*Primary Examiner*—Anhony Stashick
*Assistant Examiner*—Ned A Walker

(57) ABSTRACT

The invention relates to tear-back thermoformed high impact polystyrene lids having from at least 10% to about 15% of filler and the specified configuration of the tear-back portion. In particular, the tear back lid comprises a tear back portion defined by two sets of tear back indentations and a left and a right notch cut into a skirt defined by the outer diameter of the lid. The combination of the filler amount and tear-back configuration allows an improved tearability for the filled polystyrene lids.

17 Claims, 3 Drawing Sheets

U.S. PATENT DOCUMENTS 4,184,605 A * 1/1980 Hanson ..... 220/269
4,197,956 A * 4/1980 Murayama ..... 215/254
4,202,459 A 5/1980 DeParales et al.
4,243,156 A 1/1981 Lobbestael
4,322,015 A 3/1982 Bailey
4,361,250 A * 11/1982 Foster ..... 220/266
4,421,244 A 12/1983 Van Melle
4,441,624 A 4/1984 Sokolowski
4,460,100 A * 7/1984 Libit ..... 215/237
4,460,103 A 7/1984 Rama et al.
D274,983 S * 8/1984 Dart et al. ..... D9/447
4,473,167 A 9/1984 Bailey
4,482,071 A * 11/1984 Ishiwatari ..... 215/255
4,489,848 A 12/1984 Braude
4,502,608 A 3/1985 Mills
4,582,214 A 4/1986 Dart et al.
4,595,123 A * 6/1986 Libit ..... 222/23
D285,416 S * 9/1986 Dart et al. ..... D9/447
D286,026 S 10/1986 Rayner
4,615,459 A 10/1986 Clements
4,629,088 A 12/1986 Durgin
4,712,705 A * 12/1987 Fuehrer ..... 220/270
4,738,373 A 4/1988 DeParales
4,741,450 A 5/1988 Braude
4,747,509 A 5/1988 Florkiewicz et al.
4,753,365 A 6/1988 Seppala
4,760,934 A 8/1988 Netsch
D299,010 S 12/1988 Wall
4,887,732 A 12/1989 Matsubayashi et al.
4,898,299 A 2/1990 Herbst et al.
4,899,903 A 2/1990 Miyasaka et al.
4,915,250 A 4/1990 Hayes, Jr. et al.
4,949,865 A 8/1990 Turner
4,966,294 A 10/1990 Mack et al.
4,986,437 A 1/1991 Farmer
D319,017 S * 8/1991 Turner et al. ..... D9/438
5,048,706 A * 9/1991 de Vaujany ..... 215/251
5,065,880 A 11/1991 Horner
5,090,584 A 2/1992 Roberts et al.
5,111,961 A 5/1992 Van Melle
D329,604 S * 9/1992 Kuczer ..... D9/449
5,183,172 A 2/1993 Boller
5,197,624 A 3/1993 Dodaro
D339,290 S * 9/1993 Close ..... D9/447
5,335,812 A 8/1994 Boller
5,348,181 A 9/1994 Smith et al.
D353,769 S 12/1994 Miller
D354,438 S 1/1995 Miller
5,390,810 A 2/1995 Stroble et al.
5,392,949 A 2/1995 McKenna
D360,133 S 7/1995 Boller
5,460,286 A 10/1995 Rush et al.
5,467,879 A * 11/1995 Moore ..... 215/253
5,490,609 A 2/1996 Lane et al.
5,503,289 A 4/1996 Fox
5,538,157 A 7/1996 Proshan
5,613,619 A 3/1997 Van Melle
5,657,898 A 8/1997 Portman et al.
5,678,720 A 10/1997 Van Melle
5,699,927 A 12/1997 Lane et al.
5,839,601 A 11/1998 Van Melle
5,911,331 A 6/1999 Boller
5,947,323 A 9/1999 Freek et al.
D417,845 S 12/1999 Sadlier et al.
5,996,833 A * 12/1999 Lencioni et al. ..... 220/257.2
6,056,145 A * 5/2000 Rush et al. ..... 220/297
6,079,588 A 6/2000 Khafizov
6,089,397 A 7/2000 Van Melle
6,260,727 B1 7/2001 Durdon
D447,412 S 9/2001 Durdon
6,419,112 B1 7/2002 Bruce et al.
6,505,753 B1 1/2003 Freek et al.
6,612,456 B1 * 9/2003 Hundley et al. ..... 220/254.3
6,948,633 B2 * 9/2005 Freek et al. ..... 220/711
D530,602 S * 10/2006 Boller et al. ..... D9/435
D531,033 S 10/2006 Schmidtner et al.
7,134,569 B2 * 11/2006 Freek et al. ..... 220/711
D533,779 S 12/2006 Schmidtner et al.
7,222,741 B2 * 5/2007 Chmela et al. ..... 220/257.1
D572,587 S * 7/2008 Rush et al. ..... D9/447
2002/0100757 A1 8/2002 Shih
2003/0178426 A1 * 9/2003 Freek et al. ..... 220/254.3
2003/0201266 A1 * 10/2003 Steffan ..... 220/258.2
2004/0195239 A1 * 10/2004 Rush et al. ..... 220/254.3
2005/0092751 A1 * 5/2005 Alvares et al. ..... 220/270
2005/0145626 A1 * 7/2005 Freek et al. ..... 220/254.1
2006/0160928 A1 7/2006 Cleveland et al.
2008/0054005 A1 * 3/2008 Cai ..... 220/711

FOREIGN PATENT DOCUMENTS

CA 1229576 11/1987
CA 1236426 5/1988
CA 2016483 11/1990
CA 1288729 9/1991
CA 2031703 6/1992
CA 2091642 10/1993
CA 1324342 11/1993
CA 2156364 3/1996
CA 2195456 12/1996
CA 2187382 4/1997
CA 2169339 8/1997
CA 2258724 8/1999
CA 2335984 12/1999
CA 2299006 10/2000
CA 2380756 2/2001
CA 2328370 6/2001
CA 2404967 12/2001
CA 96234 10/2002
CA 2361850 3/2003
CA 2370440 3/2003
CA 2373818 3/2003

* cited by examiner

FILLED POLYSTYRENE TEAR BACK CONTAINER LIDS

FIELD OF THE INVENTION

The invention relates to tear-back thermoformed polystyrene lids having the specified amount of filler and tear-back portion configuration. The combination of the filler amount and tear-back configuration allows an improved tearability for the filled polystyrene lids so that the lids need not be pre-scored for use.

BACKGROUND OF THE INVENTION

Polystyrene tear back lids are commonly used in foodservice applications, in particular as covers for hot cups. For example, U.S. Pat. Nos. 4,460,103, 5,490,609 and 5,699,927 (the disclosures of which are incorporated herein in their entireties by this reference) disclose various types of tear back lids. It is also known that the tearability of a polystyrene tear back lid can be improved by designing the lid such that the tear back portion is oriented in the direction of extrusion. U.S. Pat. No. 5,613,619 (the disclosure of which is incorporated herein in its entirety by this reference) discloses such a feature.

Recently, manufacturers of polystyrene lids for hot cups have begun to investigate inclusion of filler into the lids to reduce the costs of manufacturing such lids. Historically, polystyrene lids for hot applications have not included a significant amount of filler. This is due primarily to two reasons. First, polystyrene has traditionally been a low cost raw material and, as such, there was little motivation to include filler into a formulation. Further, polystyrene used in hot cup lid applications is generally high impact polystyrene ("HIPS"). HIPS is FDA compliant and exhibits good thermoformability due to its low brittleness. Since filler is known to increase the brittleness of polystyrene, it was not desired to negate the low brittleness of HIPS with the addition of filler, since this was a property for which HIPS was selected for use in thermoformed hot cup lid applications.

The inventors herein have surprisingly found that filler can be added within a specified range to provide a suitably tearable filled thermoformed HIPS container lid when the tear-back portion of the lid is oriented in the extrusion direction of the polystyrene when the tear back lid comprises two sets of tear indentations and a tab portion.

SUMMARY OF THE INVENTION

In a significant aspect, a filled container lid is provided. The lid is prepared from a HIPS composition consisting essentially of from at least 10% to about 15% filler. The lid comprises a tear back portion defined by a left and a right notch cut into a skirt defined by an outer diameter of the lid and two sets of tear indentations, wherein the tear indentations comprise from 1 to 4 grooves thermoformed into the lid. The two sets of tear indentations are oriented in a machine direction of the extruded sheet. The left and right notches are substantially in alignment with at least one of each of the 1 to 4 grooves. The filler can specifically comprise calcium carbonate. In significant form, the filled HIPS lid exhibits excellent tearability without the need to pre-score the lid.

Still further aspects and advantages of the present invention will become readily apparent from the discussion which follows.

BRIEF DESCRIPTION OF THE DRAWINGS

While the specification concludes with claims particularly pointing out and distinctly claiming the present invention, it is believed that the present invention will be better understood from the following description in conjunction with the accompanying drawing figures wherein:

DETAILED DESCRIPTION OF THE INVENTION

Figure 1:
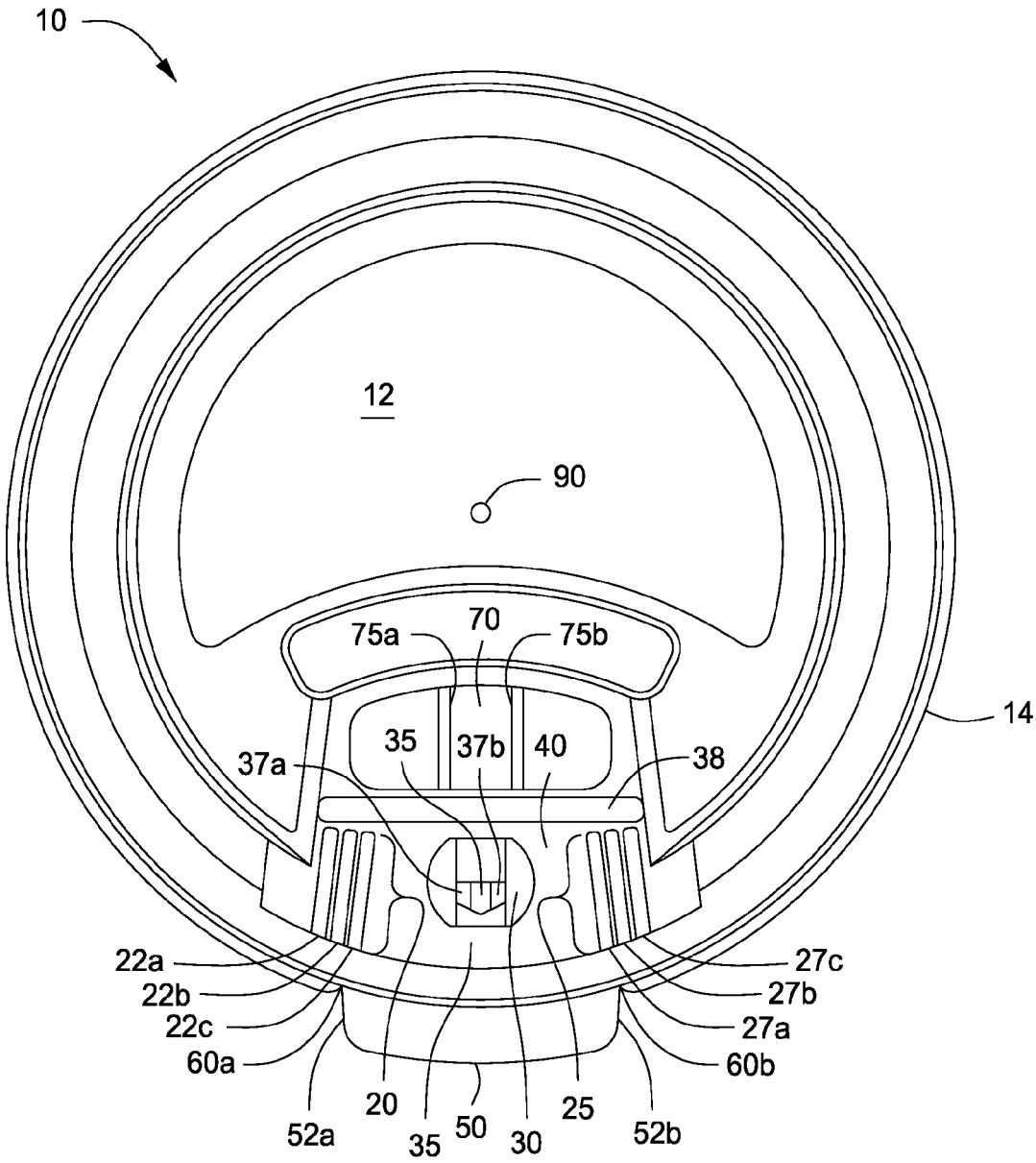
FIG. 1 is a top view of a filled HIPS container lid of the present invention.

The invention is described in detail below with reference to the Figures. Such description is for purposes of illustration only and is not limitative of the invention in any way. Numerous modifications within the spirit and scope of the present invention, set forth in the appended claims, will be readily apparent to those of skill in the at.

Unless otherwise indicated, "mil", "mils" and like terminology refers to thousandths of an inch and dimensions appear in inches. Likewise, caliper is the thickness of material and is expressed in mils.

In this detailed description of the present invention, any patent or non-patent literature referenced herein and the disclosure contained therein is intended to be and is hereby incorporated by reference. All numerical ranges and amounts are understood to be modified by the term "about," which shall have the intended meaning that all such ranges or amounts are approximately or substantially the value indicated. An indication that a numerical range or amount is greater than or less than is also understood to include values that are approximately or substantially equal to the given numerical range or amount.

The present invention is directed toward a filled polystyrene container lid that is not pre-scored. The polystyrene consists of high impact polystyrene or "HIPS" as such term is known to one of ordinary skill in the art. Importantly, the amount of filler in the HIPS composition is from at least 10% to about 15% by weight of the HIPS composition from which the lid is prepared. Further importantly, it was found that the area of the lid defining the tear back portion of the lid must be oriented in the direction that the HIPS composition is extruded into sheet form. That is, to comprise the invention herein, the tear back portion must be aligned in the machine direction of the extruded HIPS sheet from which the lid is prepared.

The inventors herein have surprisingly found that lids thermoformed from at least 10% to about 15% filled extruded HIPS sheets and comprising the tear back portion design herein exhibit improved tearability as compared to lids having from 0 to less than 10% filler. In particular, it was found that lids having at least 10 to about 15% filler were significantly easier to tear back than lids having less than at least 10% filler. Such improved ease of tearability is a desirable feature for hot cup lids in that, if less force is needed to tear the lid, the user will be less likely to exert too much force on the lid while opening the tear back portion. This, in turn, reduces the possibility that the hot beverage will spill from the container.

Also, it was found by the inventors herein that lids having less than at least 10% filler became disengaged from the container rim more readily when the user was opening the lid. In use, such disengagement is highly undesirable because of the possibility that hot beverage will spill on a consumer. Thus, the lids of the present invention provide an improved lid over those found in the prior art.

As noted, the filler amount in the lids of the present invention must be from at least 10 to about 15% of the amount of HIPS in an extruded sheet. The amount of filler can be at least 10, or 11, 12, 13, 14 or 15% by weight of the composition, as measured by total weight of the composition. It has been found that filler amounts of greater than about 15% up to about 25% filler also can provide good tearability. However, at these higher amounts, the lid shows more propensity to disengage from the container rim. Thus, the present invention addresses a HIPS lid prepared from an extruded sheet of a HIPS composition having from at least 10% to about 15% filler by weight of the composition, and no more or no less.

Without being bound by theory, it is believed that at lower amounts of filler, the HIPS resin is held tightly together. When filler is added within a certain amount, the HIPS resin polymer chains are released somewhat, thus making it easier to separate the polymer chains in the tearing action. At higher amounts of filler, it is believed that the lid becomes more brittle and less flexible. As such, the lid does not flex as well during tearing and will therefore be more likely to disengage from a container rim during use. So, although the amount of HIPS resin can be reduced at filler levels of greater than 15%, it is currently not desired to use such higher levels because of the higher possibility for lid failure during use.

HIPS is used as the base polymer in the present invention. HIPS is generally a styrene polymer that includes an elastomeric polymer wherein the elastomeric polymer is disbursed in a matrix of the styrene polymer. Elastomeric polymers are well known to improve the impact strength of the base polystyrene resin. The elastomeric polymer can be incorporated into the styrene polymer by graft copolymerization or by mechanical mixing of elastomer and styrene polymer to form a high impact polystyrene using methods well known in the art such as, for example, that disclosed in U.S. Pat. No. 4,049,595 (the disclosure of which is incorporated herein in its entirety by this reference).

HIPS can also comprise polystyrene and polybutadiene or polyisoprene mixture that exhibits improved impact resistance over standard polystyrene. Total 960E (Total Petrochemicals) and Chevron-Phillips EB6755 (Chevron-Phillips) are commercial HIPS resins that can be suitably used for the lids of the present invention.

Some examples of materials suitable for use in the present invention include any filler that would be suitable for food contact applications. Although mineral fillers such as calcium carbonate are preferred, pigments and other food safe materials can suitably be used herein. Mixtures of food safe fillers can also be used.

To provide the HIPS resin composition, a masterbatch can be prepared wherein the filler is mixed in a high level with a small amount of resin. The masterbatch can have greater than about 50% filler therein. The masterbatch will be "diluted" in a base resin to provide the desired filler end concentration.

In order to increase incorporation of filler in such high amounts in the masterbatch, mixing and processing aids can be used. For example, the filler can first be coated with a surfactant or similar processing aid to improve its dispersability into the base HIPS resin.

In addition to the use of a surfactant, a compatibilizer may also be used to improve mixing or compatibility of the filler with the HIPS.

Additives can be included in the filled HIPS compositions of the present invention. Suitable additives can include for example, antioxidants, dye, fire resistant materials, mold release agents, colorants, and other materials designed to improve the processibility of the polymer or the properties of the thermoplastic product. Such additives can be added directly into the master batch. Where additives are present, the total amount of filler is in relation to the total weight of the composition. For example, where there is 83% HIPS, 15% filler and 2% colorant as additive, a lid formed from this composition will fall within the scope of the invention herein.

When an additive is a colorant, various coloring agents can be utilized in order to make the food service product any desired color. The colorant can be in the form of a color concentrate or masterbatch as would be recognized by one of ordinary skill in the art. A suitable colorant can be titanium dioxide, which is used to make a white end product. Other coloring agents include, for example, carbon black, which is used to make a product that is black in color.

Lids made according to the present invention are thermoformed. Thermoforming processes for shaping or molding thermoplastics into various useful products by forming a heated continuous sheet of thermoplastic material in a mold whereby the continuous sheet takes the shape of the mold are well known in the art. Commercially available machinery for such processes is designed so that the continuous sheet of filled HIPS, as in the present invention, is fed through an oven and heated to bring the continuous sheet of filled HIPS to a suitable thermoforming temperature. Alternatively, the continuous sheet can come directly from the extruder and can be brought to the proper thermoforming temperature by means of a series of rollers, which can either be heated or cooled, as appropriate. In either case, a thermoforming station comprises molds having the desired lid shape. The continuous sheet can either be draped over the mold or vacuum formed into the cavity to take the desired shape.

The lids of the present invention are formed from the continuous sheet that can then be cut or separated into individual thermoformed lids at a cutting station. Significantly, the tear back portion of the lid is not scored during the cutting process, nor is it scored at any other time in the lid preparation process. The fact that the lid is not pre-scored is a marked difference from prior art tear back lids, which typically include a scoring step in the cutting process so as to provide a tear back portion that can be suitably torn in use. Trim from the cutting process can be used as regrind material to be used in the feedstock of the lid forming process.

Referring now to FIG. 1, lid 10 is circular in shape with a substantially flat central cover portion 12 and a downwardly depending and outwardly curved annular skirt 14. As noted, it is important for lid 10 to fit tightly on the container (not shown) to prevent disengagement of lid 10 in use. At filler levels of less than 10% or greater than about 15%, it has been found that the lid is more likely to disengage from the container during the tear hack process.

Lid 10 comprises sets 20 and 25 of tear back indentations, wherein each set 20 and 25 comprise grooves 22*a*, 22*b* and 22*c* and 27*a*, 27*b* and 27*c* that are oriented on either side of a latch 30. Sets 20 and 25 can each, independently, comprise 1, 2, 3 or 4 grooves, although 3 are shown in each of sets 20 and 25 in FIG. 1.

Skirt 14 comprises a tab 50 in connecting relation therewith. Tab 50 comprises notches 60*a* and 60*b* on either side thereof. The left and right sides of tab 50, which are sides 52*a* and 52*b* are in substantial alignment with notches 60*a* and 60*b* respectively. Notch 60*a* is in substantial alignment with at least one of grooves 22*a*, 22*b* or 22*c* and notch 60*b* is in substantial alignment with at least one of tear back grooves 27*a*, 27*b* or 27*c*. As used herein, "substantial alignment" means that when tab 50 is pulled to open tear back portion 50, there will be a single tear line on either side of tear back portion 50. These lines can be somewhat crooked after opening of tear back portion 50 by a user, however, when the tab sides 52*a* and 52*b* are in substantial alignment with notches 60*a* and 60*b*, and notch 60*a* is in substantial alignment with one of the grooves 22*a*, 22*b* or 22*c* and notch 60*b* is in substantial alignment with one of the grooves 27*a*, 27*b* or 27*c*, the tear back portion will be comfortable for a user drinking out of tear back portion 50.

Latch 30 can have a raised protrusion 35 formed in the lid surface; raised protrusion 35 can have latching members 37*a* and 37*b* associated therewith. Latch 35 is formed into the lid 10 surface by thermoforming of an extruded HIPS sheet (not shown) using a suitable mold (not shown). Latch 35 is hinged at hinge 38. Tear back portion 40 may be latched in the open position by inserting the raised protrusion 35 into recess 70 having engagement members 75*a* and 75*b* so that latching members 37*a* and 37*b* of the raised protrusion 35 engage with engagement members 75*a* and 75*b* formed in opposing side walls of the recess 70.

As noted previously, it has been surprisingly found that if grooves 22*a*, 22*b*, 22*c*, 27*a*, 27*b* and 27*c* are oriented in the machine direction of the extruded HIPS sheet, the tearability of the tear back portion 40 is greatly improved.

In use, the filled HIPS lid 10 of the present invention is somewhat flexible in the range of fillers corresponding to the present invention so that, when the raised protrusion 35 is inserted into the recess 70, the latching members 37*a* and 37*b* are pushed past the corresponding engagement members 75*a* and 75*b*. Tear-back portion 40 is then latched in the open position because each first latching member 37*a* and 37*b* engages its respective second latching members 75*a* and 75*b*. To "unlatch" the tear-back portion 40, the user exerts an upward force on the tear-back portion 40 (for example, by pulling upward on the tab) to enable the latching members 37*a* and 37*b* to disengage the engagement members 75*a* and 75*b*. Tear back portion 40 can then be seated on the rim of the container (not shown) to approximate a seal such that a beverage will be less likely to spill from the container in use.

More particularly, the raised protrusion 35 flexes, thereby allowing the latching members 37*a* and 37*b* to be more easily pushed past the engagement members 75*a* and 75*b* to latch the tear-back portion 40 in the open position. Also, after tear-back portion 40 is latched, latching members 37*a* and 37*b* resist disengagement from engagement members 75*a* and 75*b*. Upon unlatching of tear-back portion 40, latch 35 and, in particular, its upper portion, returns substantially to its original configuration.

Vent hole 90 can be present to allow venting of a hot liquid (not shown) from the container (not shown).

Figure 2:
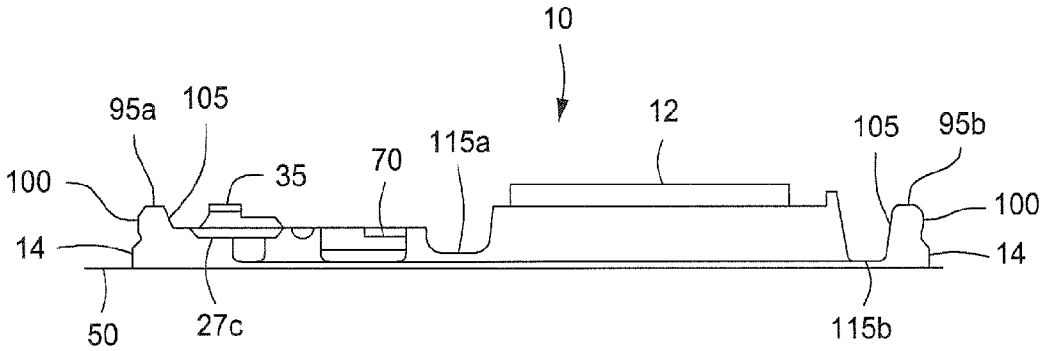
FIG. 2 is a side view of a filled HIPS container lid of the present invention.

FIG. 2 shows a side view of lid 10. Container engagements 95*a* and 95*b* are defined by bead outer diameter 100 and rim interior diameter 105. Wells 115*a* and 115*b* are also visible in FIG. 2.

Figure 3:
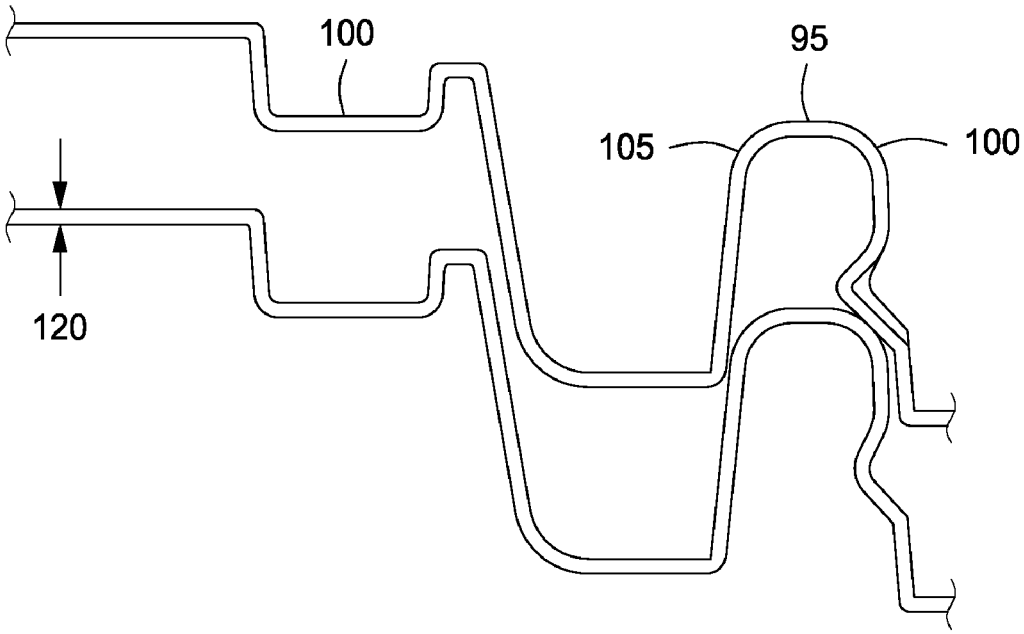
FIG. 3 shows stacking of 2 filled HIPS lids of the present invention.

FIG. 3 shows a stacking of lids 10*a* and 10*b*. The lids should be stackable to allow ease of use. Thickness 120 is visible in FIG. 3. In one aspect, the thickness is less than about 2.54 mm. In another aspect, the thickness is greater than about 0.1 mm and less than about 0.64 mm. In still another aspect, the thickness is greater than about 0.76 mm and less than about 2.03 mm.

EXAMPLES

The following Examples are put forth so as to provide those of ordinary skill in the art with a complete disclosure and description of how the present invention is practiced, and associated processes and methods are constructed, used, and evaluated, and are intended to be purely exemplary of the invention and are not intended to limit the scope of what the inventors regard as their invention. Efforts have been made to ensure accuracy with respect to numbers (e.g., amounts, temperature, etc.) but some errors and deviations should be accounted for. Unless indicated otherwise, parts are parts by weight, temperature is as specified or is at ambient temperature, and pressure is at or near atmospheric.

Example 1

Test of Multiple Filler Levels

Lids were made from filled HIPS resin to provide lids having the configuration shown herein. The resin used was from Chevron-Phillips and comprised a mixture of EB6085 and EA3300.

The amount of filler was tested as set out below. No colorant was included in the noted samples, thereby providing a translucent lid. The depth of the grooves forming each set of tear back portions was also examined as a variable. The lids were formed as set forth in the diagram of FIG. 1.

TABLE 1

Prototype Lids Tested

| Targeted % of $CaCO_3$ Added | Deep Tear Back Rib Molds | Shallow Tear Back Rib Molds | Color |
|---|---|---|---|
| 0% $CaCO_3$ | 21 & 24 | 25 & 27 | Translucent |
| 10% $CaCO_3$ | 21 & 24 | 25 & 27 | Translucent |
| 15% $CaCO_3$ | 21 & 24 | 25 & 27 | Translucent |
| 20% $CaCO_3$ | 21 & 24 | 25 & 27 | Translucent |
| 25% $CaCO_3$ | 21 & 24 | 25 & 27 | Translucent |

Observations:

Samples made with 11% and 15% $CaCO_3$ had the best performance as compared to the other amounts of $CaCO_3$.

Lids made with the deeper tear back ribs had slightly better performance than the lids made with the shallow tear back ribs.

Results:

Dimensions:

All lids averaged within 3% of an overall mean weight of 2.427 grams.

All lids sets averaged within 0.002" of the overall mean BOD (bead outer diameter) of 3.318"

The RID (rim interior diameter) of the sample set without $CaCO_3$ averaged 0.005" to 0.007" higher than the variables with $CaCO_3$.

TABLE 2

Lid Dimensions and Weight

| Filler Amount (% $CaCO_3$) | Weight (G) | BOD (Inches) | RID (Inches) |
|---|---|---|---|
| 0 | 2.435 | 3.318 | 3.272 |
| 10 | 2.377 | 3.318 | 3.267 |

TABLE 2-continued

| Lid Dimensions and Weight | | | |
|---|---|---|---|
| Filler Amount (% $CaCO_3$) | Weight (G) | BOD (Inches) | RID (Inches) |
| 15 | 2.413 | 3.319 | 3.266 |
| 20 | 2.510 | 3.319 | 3.267 |
| 25 | 2.402 | 3.316 | 3.265 |

Lid Fit Testing:

Lid fit testing was conducted using a Lid Fit Test designed to determine if the lid fit is adequate enough to prevent leakage when the cup is tilted. During testing, one of the 12 lids tested with 20% $CaCO_3$ leaked 2 drops. (See Table 3)

Tear Tab Testing:

All lids were subjectively observed to have satisfactory to slightly difficult tear back resistance.

The 10% and 15% $CaCO_3$ filled lids each tore back without the lid becoming disengaged from the container rim.

Seventeen % of the 20% and 25% $CaCO_3$ lids became disengaged from the container during the tear back operation.

Lids without $CaCO_3$ had by far the worst performance with 92% of the lids falling off during the tear back operation. Besides not having $CaCO_3$, the average RID of this variable was 0.005" to 0.007" bigger than the other variables. The higher RID may have contributed to the poor tear back performance.

Overall, lids made with the deeper tear back grooves preformed slightly better than the lids with the shallower tear back groove. Of the lids tested that had deeper grooves, 75% stayed on the cup during the tear back process compared to 66% of the lids with the shallower grooves. When the lids made without $CaCO_3$ are not included in this tally, 96% of the lids with the deeper grooves stayed on the cup during the tear back process compared to 88% of the lids with the shallower grooves.

TABLE 3

| Lid Test Performance | | | | | |
|---|---|---|---|---|---|
| $CaCO_3$ Amount % in HIPS | Lid Fit Test (% Pass) | Tear Back Lid Properly (% Pass) | Tab Locked on 1st Try (% Pass) | Subjective Lid Fit | Cracking After Capping |
| 0 | 100 | 8 | 67 | Good | None |
| 10 | 100 | 100 | 83 | Good | None |
| 15 | 100 | 100 | 92 | Good | None |
| 20 | 92 | 83 | 92 | Good | None |
| 25 | 100 | 83 | 92 | Good | None |

Example 2

Additional Filler Test Data

Lid Dimensions:

Lids including colorant were tested at 0% $CaCO_3$ and 15% $CaCO_3$. The formula was as follows:

55%—EB6025

23%—EA3300

15%—$CaCO_3$

7% brown colorant

A masterbatch of colorant and $CaCO_3$ was prepared with the EA3300, followed by dilution of the masterbatch in the EB6025.

Observations:

Lids not having $CaCO_3$ weighed about 5% less than the lids with $CaCO_3$.

The average BOD (bead outside diameter) of the two trial variables was within 0.001" of each other.

The RID (rim interior diameter) of the sample set without $CaCO_3$ averaged 0.004" smaller than the variable with $CaCO_3$.

TABLE 4

| Lid Dimensions and Weight | | | |
|---|---|---|---|
| Filler Parameters | Weight (Grams) | BOD (Inches) | RID (Inches) |
| No $CaCO_3$ | 2.324 | 3.318 | 3.264 |
| 15% $CaCO_3$ | 2.438 | 3.319 | 3.268 |

Lid Fit Testing:

Lid fit testing was conducted using an in-house Lid Fit Test which is designed to determine if the lid fit is adequate enough to prevent leakage when the cup is tilted.

Tear Tab Testing:

All lids were subjectively noted as having a good to slightly difficult tear back resistance.

Lids prepared from HIPS with 15% $CaCO_3$ exhibited the best overall tear back performance. However, 3 of 16 lids prepared from HIPS without $CaCO_3$ came off the cup during the tear back operation.

TABLE 5

| Lid Test Performance | | | | |
|---|---|---|---|---|
| Amount $CaCO_3$ | Lid Fit Test (% Pass) | Lid Properly On (% Pass) | Tear Back Lid Locked on 1st Try (% Pass) | Subjective Fit |
| None | 94 | 81 | 100 | Good |
| 15% | 88 | 100 | 94 | Good |

The tear back portions of the 15% $CaCO_3$ filled lids consistently tore back through the area with the tear back grooves when used on containers with hot coffee. Tearing was better when the lids were placed on hot coffee than when torn back on empty cups. The lids tabs from lids without $CaCO_3$ did not consistently tear back through the area with the tear back grooves.

Subjectively, the lids fit well on the test cups.

While the invention has been described in connection with one aspect, modifications within the scope of the appended claims will be readily apparent to those of skill in the art.

What is claimed is:

1. A container lid prepared from an extruded sheet of a high impact polystyrene resin composition, wherein the high impact polystyrene resin composition comprises about 10% to about 15% filler, and wherein the lid comprises:

a) a tear back portion defined by:

i) a downwardly directed annular skirt defined by an outer diameter of the lid;

ii) a tab in connecting relation with the skirt defining a grabbing location for a user, wherein the tab has a left side and a right side;

iii) a left and a right notch cut into the skirt in substantial alignment with the respective left and right sides of the tab; and iv) two sets of tear indentations defining a left and right side of the tear back portion, wherein the sets each, independently, comprise from 2 to 4 grooves thermoformed into the lid, wherein a longitudinal axis of each groove of the two sets is oriented in a machine direction of the extruded sheet, and wherein the left and right notches are substantially in alignment with the longitudinal axis of at least one of the grooves in the left and right sides of the tear back portion, respectively, and wherein the tear back portion of the lid is not pre-scored prior to use.

2. The container lid of claim 1, wherein each set, independently, comprises 2 or 3 grooves.

3. The container lid of claim 1 having a locking engagement associated with the tear back portion, thereby allowing the tear back portion to be secured in an open position during use.

4. The container lid of claim 1, wherein the filler consists essentially of calcium carbonate.

5. The container lid of claim 1, further comprising a vent hole disposed through the lid.

6. A lid formed from an extruded sheet of a high impact polystyrene resin composition, wherein the high impact polystyrene resin composition comprises about 10% to about 15% filler, and wherein the lid comprises:

an unscored tear back portion comprising:

a downwardly directed annular skirt defined by an outer diameter of the lid;

a tab extending outwardly from the skirt;

a first notch disposed in the skirt on a first side of the tab;

a second notch disposed in the skirt on a second side of the tab; and a first set of tear indentations disposed on the first side of the tear back portion;

a second set of tear indentations disposed on the second side of the tear back portion, wherein the first set and the second set of tear indentations each comprise from 2 to 4 grooves, and wherein the first and second notches and the first and second sets of tear indentations are substantially oriented in the machine direction of the extruded sheet; and a latch centrally-disposed in the tear back portion and protruding therefrom.

7. The lid of claim 6, wherein the filler comprises calcium carbonate.

8. The lid of claim 6, further comprising a vent hole disposed through the lid.

9. The lid of claim 6, wherein the first set and the second set of tear indentations each comprise 2 or 3 grooves.

10. The lid of claim 6, further comprising a recess disposed in the lid and adapted to engage the latch.

11. The lid of claim 10, wherein the latch comprises a raised protrusion having one or more latching members disposed thereon.

12. The lid of claim 11, wherein the recess comprises one or more engagement members adapted to engage with the one or more latching members.

13. A lid formed from an extruded sheet of a high impact polystyrene resin composition comprising about 10% to about 15% filler, wherein the lid comprises:

an unscored tear back portion comprising:

a downwardly directed annular skirt defined by an outer diameter of the lid;

a tab extending outwardly from the skirt;

a first notch disposed in the skirt on a first side of the tab;

a second notch disposed in the skirt on a second side of the tab; and a first set of tear indentations disposed on the first side of the tear back portion; and a second set of tear indentations disposed on the second side of the tear back portion, wherein the first set and the second set of tear indentations each comprise 2 to 4 grooves, and wherein the first notch and the second notch are each substantially parallel with a longitudinal axis of at least one of the grooves disposed on the first set and the second set of tear indentations, and wherein the first and second notches and the first and second sets of tear indentations are substantially oriented in the machine direction of the extruded sheet.

14. The lid of claim 13, wherein the filler comprises calcium carbonate.

15. The lid of claim 13, further comprising a latch member formed in the tear back portion and extending therefrom and a recess formed in the lid and adapted to engage with and secure to the latch member.

16. The lid of claim 13, further comprising a locking engagement mechanism with the tear back portion adapted to engage with a receiving mechanism disposed in the lid when the tear back portion is torn back.

17. The lid of claim 13, further comprising a vent hole disposed through the lid.

* * * * *